US007150118B1

(12) United States Patent
Benton et al.

(10) Patent No.: US 7,150,118 B1
(45) Date of Patent: Dec. 19, 2006

(54) DISPOSABLE HAZARD WARNING AND SPILL PICK-UP KIT

(75) Inventors: Michael J. Benton, Fort Worth, TX (US); David Lewis Wilson, Dallas, TX (US); Chad Hewitt Jones, Frisco, TX (US)

(73) Assignee: NCH Corporation, Irving, TX (US)

( * ) Notice: Subject to any disclaimer, the term of this patent is extended or adjusted under 35 U.S.C. 154(b) by 0 days.

(21) Appl. No.: 11/364,591

(22) Filed: Feb. 28, 2006

(51) Int. Cl.
*B65D 69/00* (2006.01)
*G09F 15/00* (2006.01)

(52) U.S. Cl. ..... 40/610; 116/116 P; 206/223

(58) Field of Classification Search ..... 40/610; 116/63 P, 63 T, 63 C
See application file for complete search history.

(56) References Cited

U.S. PATENT DOCUMENTS 490,680 A * 1/1893 Robert ..... 229/116
3,765,044 A * 10/1973 Hanahan et al. ..... 15/104.8
4,133,137 A * 1/1979 van Adelsberg ..... 43/114
4,395,987 A * 8/1983 Kobayashi et al. ..... 123/458
4,798,747 A * 1/1989 Laramee ..... 428/12
4,917,238 A * 4/1990 Schumacher ..... 206/223
5,036,990 A * 8/1991 Verchere ..... 211/85.29
5,090,349 A * 2/1992 Wilson ..... 116/63 C
D395,334 S 6/1998 Eberle et al.
6,131,320 A 10/2000 Eberle et al.

* cited by examiner

*Primary Examiner*—Cassandra Davis
(74) *Attorney, Agent, or Firm*—Locke Liddell & Sapp LLP

(57) ABSTRACT

A disposable kit is provided that comprises a foldable warning sign, protective gloves, a dustpan and scraper for use in cleaning up broken objects or spilled particulate or powdered solid matter, a pad containing super-absorbent polymer for use in cleaning up spilled liquid matter, and a waste disposal bag sufficiently large to contain both the cleaned-up matter and the other elements of the kit following use. A low-profile, under-shelf bracket to support and store the kit is also disclosed.

18 Claims, 3 Drawing Sheets

DISPOSABLE HAZARD WARNING AND SPILL PICK-UP KIT

BACKGROUND OF THE INVENTION

1. Field of the Invention

This invention relates to a disposable kit that is useful for cleaning up a minor breakage or spill of a solid or liquid material of the type that could constitute a hazard if left on the floor of a store, office, other place of business or an institution, and also relates a disposable warning sign included in said kit that is portable, can be quickly and easily erected, and will warn others of the presence of the breakage or spill until it is cleaned up and the sign is removed. The subject kit is optionally provided with a plurality of low-profile, under-shelf mounting brackets.

2. Description of Related Art

Accidental breakage of glass containers or the like, or spills of liquids, particulate matter, powder or the like frequently occur, for example, in stores, offices, hospitals, schools, public areas, and the like. Such breakage or spills often involve hazardous material that can injure, infect or otherwise harm a person who accidentally encounters the scene, who comes into contact with hazardous material while cleaning up the affected area. Once breakage or a spill occurs, it is important to warn other individuals in the vicinity as to the existence of the spill so that they do not inadvertently step into or track the broken or spilled material until such time as it can be properly cleaned up. Because of the many different types of materials that may be broken or spilled, different tools or products may be required to effect such cleanup.

In the past, when breakage or a spill has occurred, a common practice has been to inform an employee or other individual having cleanup responsibility, after which that person retrieves from a utility closet, storeroom, or the like, a portable sign or marker cone, broom, dustpan, waste disposal bag, gloves, bucket or mop, depending upon the nature of the material involved. Once the worker has assembled the necessary items, he or she takes them to the affected area, and first marks the area by positioning a cone or erecting a portable sign. After cleaning up the breakage or spill, the cone or sign must be retrieved, any waste must be disposed of, and all tools must be returned to an appropriate location, cleaned and stored.

Although the volume or nature of some spills may require use of the tools and procedures similar to those described above, many spills are more minor in nature, and can be handled much more expeditiously if materials having the necessary utility and permitting safe handling of any spilled matter are readily at hand.

SUMMARY OF THE INVENTION

A kit is disclosed herein that is relatively inexpensive, can be conveniently stored with minimal space requirements, comprises a plainly visible warning sign that is easily erected and removed, includes tools for cleaning up breakage or spills of either solid or liquid matter, or both, without such matter contacting the skin of the user, and can be disposed of conveniently and efficiently following use.

According to a preferred embodiment of the invention, a kit is provided that comprises a foldable warning sign, protective gloves, a dustpan and scraper for broken objects or solid matter, a pad containing super-absorbent polymer for liquid matter, and a waste disposal bag sufficiently large to contain both the cleaned-up matter and the other elements of the kit following use.

Because the preferred kits of the invention are relatively flat and thin when shipped and stored prior to use, a stack of such kits can be conveniently stored on a shelf in a check-out stand, customer-service desk, utility area, or the like, where they can be quickly and conveniently accessed or distributed if a spill occurs. According to a particularly preferred embodiment of the invention, two low-profile, under-shelf mounting brackets are provided for easy attachment to the underside of a typical merchandise display shelf. Such brackets are able to support and store one or more of the preferred kits of the invention in a position that is out of sight or visually unnoticeable to the ordinary shopper but is easily accessible to store employees who have need for the kit to facilitate rapid clean-up in the event of a spill.

BRIEF DESCRIPTION OF THE DRAWINGS

A preferred embodiment of the apparatus of the invention is further described and explained in relation to the following drawings wherein.

DESCRIPTION OF THE PREFERRED EMBODIMENTS

Figure 1:
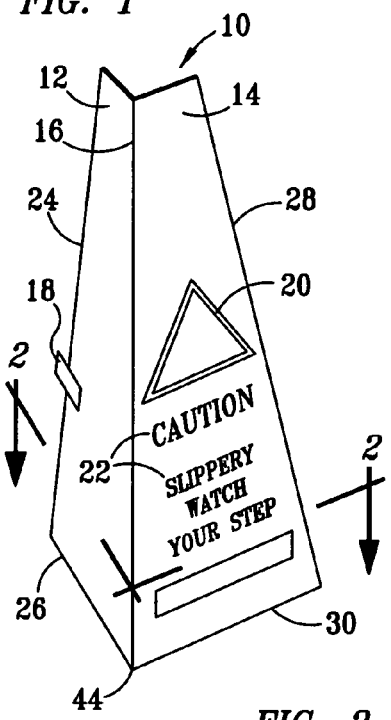
FIG. 1 is a front perspective view of a preferred embodiment of the disposable hazard warning and spill pick-up kit of the invention.
Figure 2:
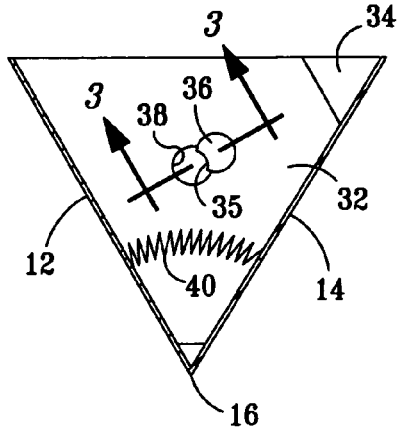
FIG. 2 is a cross-sectional view taken along line 2—2 of FIG. 1.
Figure 3:
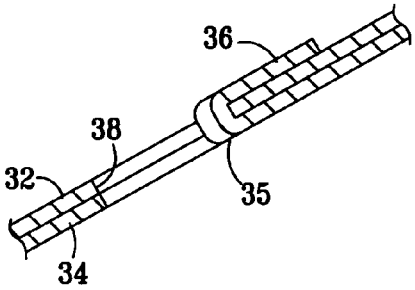
FIG. 3 is an enlarged, cross-sectional detail view, partially broken away, taken along line 3 of FIG. 2 to better illustrate a preferred manner in which two opposed base members of the sign as shown in FIG. 1 interlock to provide a stable base to support the sign in an upright position.
Figure 4:
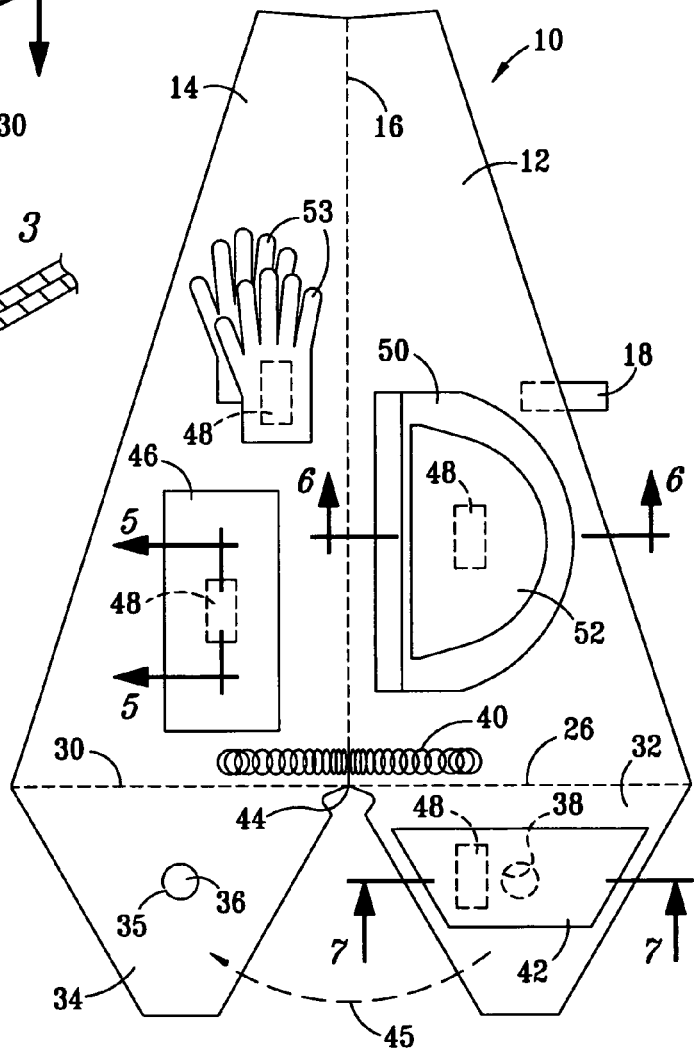
FIG. 4 is a top plan view showing the inside surfaces of the kit of FIG. 1 folded open and laid flat prior to use.
Figure 8:
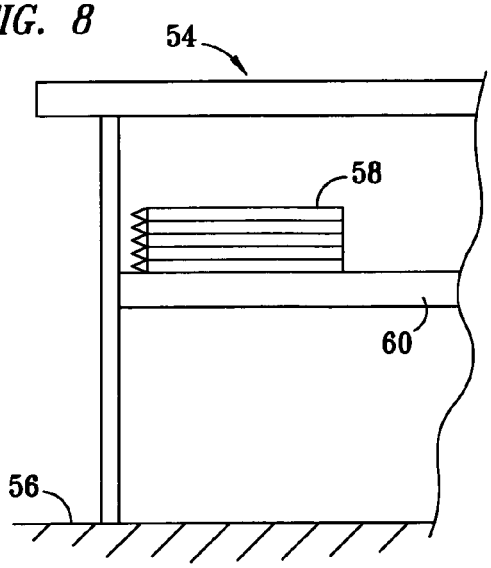
FIG. 8 is a front elevation view, partially broken away, of a store counter having a plurality of the subject kits stored on a shelf beneath the counter for quick access in the event of a spill.
Figure 9:
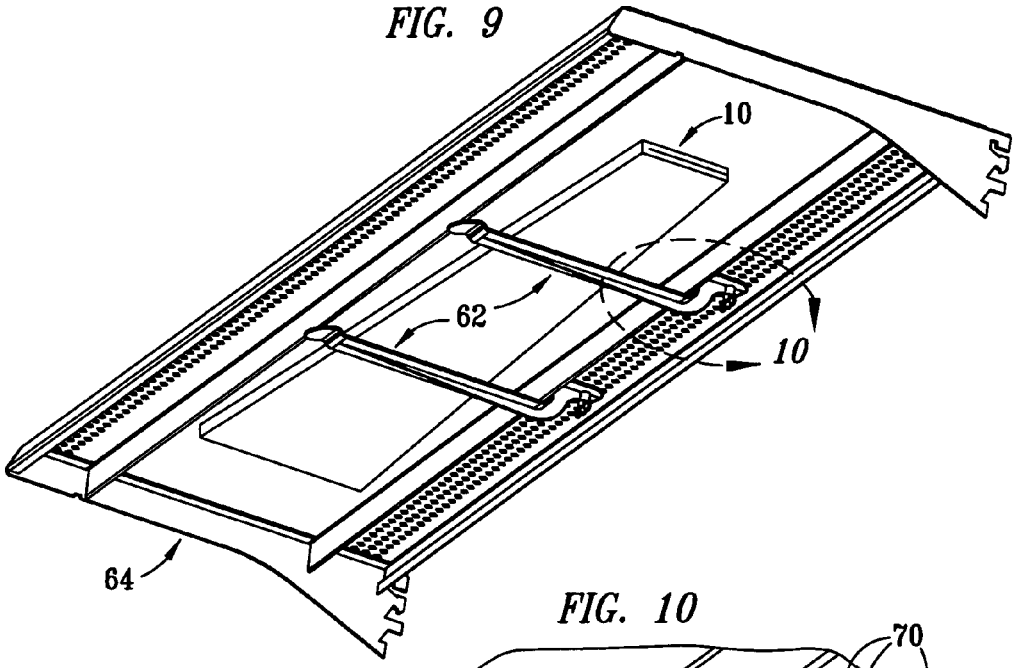
FIG. 9 is a bottom perspective view of a merchandise display shelf having two of low-profile brackets of the invention mounted beneath the shelf in a position to support, store and provide easy access to a kit of the invention as shown.
Figure 10:
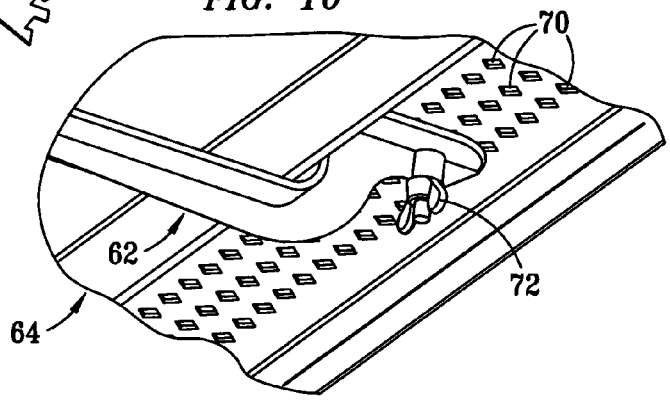
FIG. 10 is a detail perspective view taken from FIG. 9 that better illustrates the attachment of a low-profile bracket to the underside of the shelf.

Referring to FIGS. 1, 2 and 4, a preferred kit 10 of the invention preferably comprises a foldable sign member having first and second side members 12, 14 that are foldably connected along line 16, and oppositely disposed free edges 24, 28 that can be secured by tape strip 18 or another similarly effective means to maintain kit 10 in a substantially flat configuration prior to use. FIG. 8 depicts a plurality of such kits in their substantially flat, pre-use configuration, organized into a stack 58 disposed on shelf 60 beneath a checkout counter 54 sitting on floor 56, so as to be easily accessible if needed to clean up breakage or a spill. FIGS. 9–12 additionally disclose two low-profile, under-shelf brackets that can be releasably attached to the underside of a merchandise display shelf to support one or more of the kits of the invention in a position on a store aisle that is not readily apparent to shoppers but is quickly and conveniently accessible to store personnel for use in cleaning up a spill.

First and second side members 12, 14 are preferably die cut from a web or sheet of a suitable foldable but substantially stiff or rigid material such as, for example, cardboard, corrugated board, plastic-coated cardboard, plastic sheet, and laminates thereof. The sheet material used to make first and second side members 12, 14, can be pre-creased at the desired fold lines or, if needed because of the rigidity of the material, scored to facilitate folding along the desired lines. Symbols 20 or lettering 22 can be pre-printed or stamped onto the outwardly facing surface of at least one of side members 12, 14, or a pre-printed label can be attached if preferred, to provide an appropriate warning to passersby who might otherwise step into or track through the spill.

Base members 32, 34 are preferably die cut as part of the sign member, and are most preferably foldably connected to the bottom edges of side members 12, 14 along fold lines 26, 30, respectively, as shown in FIG. 4. If desired, during manufacture, base members 32, 34 can each be folded upwardly between the inside surfaces of side members 12, 14 prior to folding side members 12, 14 together and securing free edges 24, 28 (FIG. 1) with releasable tape strip 18 or another similarly effective conventional fastening means. This will reduce the overall dimensions of kit 10 during shipping and storage prior to use.

Referring to FIG. 4, a plurality of elements including at least absorbent pad 42, waste disposal bag 46, dustpan 50, scraper 52 and protective gloves 53, are all attached, either directly or indirectly (by attachment to another of said elements) to one of the interiorly facing surfaces of side members 12, 14 or base members 32, 34, in such manner that the positioning of such elements does not prevent such side members and base members from being foldable into the storage position as depicted, for example, in FIG. 8. Preferred means for use in attaching elements 42, 46, 50, 52 and 53 to the sign member (or to each other) are strips 48 of a suitable conventional, releasable polymeric adhesive that can be used without perforating or otherwise significantly damaging the other portions of kit 10 during removal.

Figure 6:
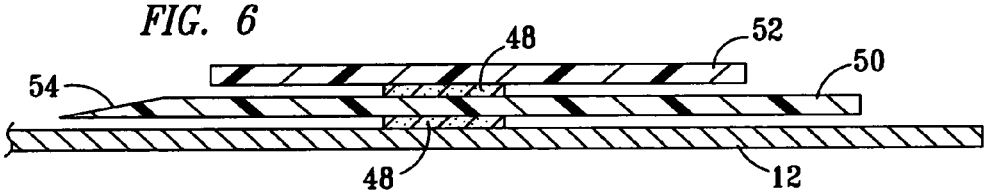
FIG. 6 is an enlarged cross-sectional view, partially broken away, taken along line 6—6 of FIG. 4.
Figure 7:
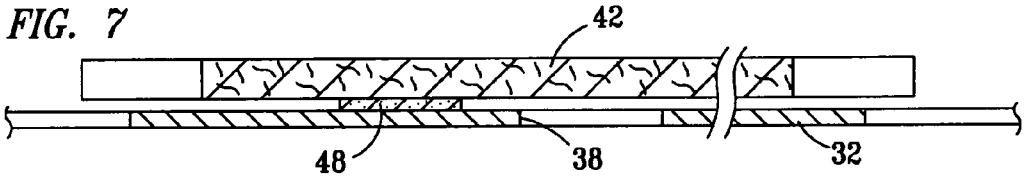
FIG. 7 is an enlarged cross-sectional view, partially broken away, taken along line 7—7 of FIG. 4.

Absorbent pad 42 can be made in any convenient shape and can be attached to either of side members 12, 14 or to one (or both, if 2 pads are preferred) of base members 32, 34, as desired. According to a particularly preferred embodiment of the invention as shown in FIG. 7, absorbent pad 42 comprises a well known, commercially available super absorbent polymeric ("SAP") material that can be provided as a spray-on coating over a backing sheet or deposited as a granular filler material distributed throughout the interior of the pad. Although pad 42 as shown in FIGS. 4 and 6 is simplified for illustrative purposes, the front surface of absorbent pad 42 is desirably made of a fibrous or porous mesh material that facilitates the absorption of liquid into the interior of the pad, and the back surface of pad 42 is desirably made of a plastic or plasticized sheet material that is substantially impervious to the passage of liquid. Although the use of SAP is preferred, other cellulosic materials and wicking polymeric materials can likewise be used in absorbent pads 42 of the invention if desired.

Figure 5:
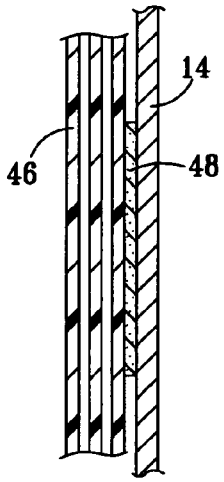
FIG. 5 is an enlarged cross-sectional view, partially broken away, taken along line 5—5 of FIG. 4.

Waste disposal bag 46 is preferably a folded plastic bag of suitable material and thickness that is further depicted in a folded configuration in FIG. 5, in which the overlying layers of plastic have been enlarged and separated for illustrative purposes. When fully unfolded and expanded, disposal bag 46 will preferably have dimensions and volume adequate to contain the broken or spilled waste material together with the other elements originally present in the kit and also the sign member after it is returned to its former substantially flat configuration. In this regard, additional fold or score lines can be provided in each of side members 12, 14 to facilitate further folding, collapse and reduction of the overall dimensions of the sign member following removal of the other elements for use.

Dustpan 50 and scraper 52 are preferably molded, thermoformed or stamped from a suitable plastic or cardboard material, and are desirably sufficiently rigid to facilitate cleanup of any broken glass or spilled particulate matter. Referring to FIG. 6, dustpan 50 is preferably further provided with a beveled leading edge to facilitate pickup of any material swept toward it by scraper 52.

Protective gloves 53 are preferably made of a conventional lightweight, flexible but liquid impermeable polymeric material that is primarily intended to prevent direct contact of spillages with the skin of the user.

Referring to FIGS. 1–4, after detaching elements 42, 46, 48, 50 and 53 from the sign member of kit 10 (or such of them as may be needed, depending upon the nature of the breakage or spillage), the sign member is preferably erected at the use site. According to a preferred embodiment of the invention, the sign member as depicted in FIG. 1 can be erected by folding flaps 32 and 34 upwardly from the position shown in FIG. 4, and then folding side members 12, 14 toward each other about fold line 16 so that base member 32 overlies base member 34 until tab 36 (connected by hinge 35 to base member 34) is cooperatively aligned with opening or aperture 38 in base member 32, at which time tab 36 can be folded upwardly through aperture 38 to releasably fix the positions of base members 32, 34 relative to each other as shown in FIG. 2, and thereby also substantially fix the position of side members 12, 14 relative to each other and to cooperating base members 32, 34 until such time as tab 36 is manually release, permitting side members 12, 14 and base members 32, 34 to be collapsed again to their original positions (or smaller, if additional fold lines or score lines are provided as discussed above) for subsequent disposal.

Referring to FIGS. 32 and 4, collapsible plastic spring member 40 is desirably provided to assist in biasing side members 12, 14 relative to each other around fold line 16, but is not required. Similarly, while kit 10 of the invention is described herein in relation to its preferred embodiments, it will be appreciated by those of ordinary skill in the art upon reading this disclosure in relation to the accompanying drawings that other functionally similar structural equivalents can be substituted for those disclosed herein within the scope of the invention. Thus, for example, a die-cut blank for the sign member can likewise be provided that comprises a unitary foldable base member that does not require the presence or manipulation of tab 36 for erection or collapse. Likewise, a sign member having a polygonal, rather than angular, cross-section when erected can be substituted for that disclosed herein, or a base support member having flaps that fold outwardly from side members 12, 14 can be substituted for those disclosed herein.

Because spills frequently occur somewhere along a store aisle rather than in the checkout counter area, elongate low-profile support brackets are desirably provided for storing at least one of the waste hazard warning sign and spill pick-up kits 10 of the invention in a position that is easily accessible to store personnel if a spill occurs, but that will not take up valuable floor-space and will not be unsightly to shoppers. Referring to FIGS. 9–12, low-profile, under-shelf brackets 62 are disclosed that are either not visible or are barely visible to shoppers and that do not interfere substantially with the placement of merchandise on the shelve below the shelf 64 to which brackets 62 are releasably attached. Spill pick-up kit 10 is desirably supported by and stored on a pair of laterally spaced brackets 62 that are mounted as shown, so that kit 10 can be easily disengaged and removed for use when needed. It will also be appreciated upon reading this disclosure that such low-profile, under-shelf brackets can likewise be used for supporting articles other than kits 10.

Figure 11:
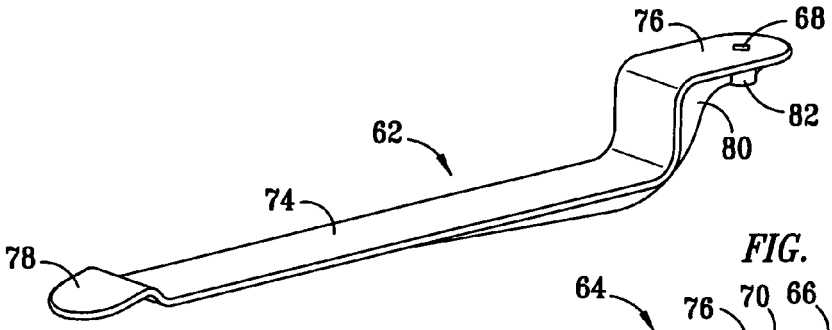
FIG. 11 is a top perspective view of a low-profile, under-shelf bracket of the invention.
Figure 12:
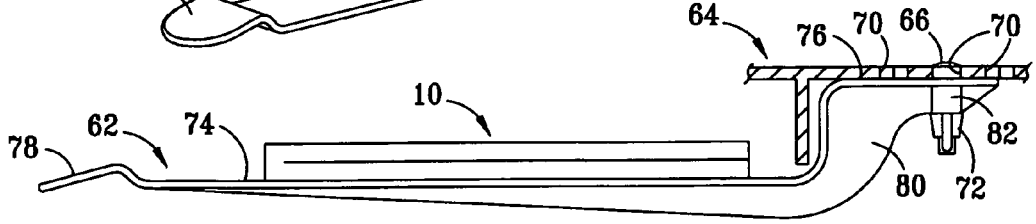
FIG. 12 is a right side elevation view of a low-profile, under-shelf bracket of the invention attached to the underside of a merchandise display shelf (shown in cross-section), the bracket supporting a disposable hazard warning and spill pick-up kit as described above.

Brackets 62 are preferably attached to the underside of shelf 64 by means of a screw 66 passed downwardly through an aperture 70 in the shelf and a cylindrical receptacle 82 in bracket 62, where the free end is threadedly engaged or otherwise releasably captured by a wing nut 72 or other similarly effective fastening device. Referring to FIGS. 11–12, each bracket 62 preferably further comprises an upwardly facing attachment surface 76, an upwardly facing kit support surface 74 that is stepped down from attachment surface 76 a sufficient distance to provide clearance with the shelf support structure and for receiving at least one kit 10 without interfering unnecessarily with merchandise placement on another shelf (not shown) disposed beneath the bracket. Kit support surface 74 preferably further comprises an upwardly rising recurved section 78 near its free end that facilitates insertion and positioning of kit 10 on brace 62. Upwardly rising recurved section 78 helps prevent kit 10 from being accidentally displaced if bumped while removing merchandise from the shelf below but also permits convenient removal of kit 10 when needed for use.

According to a preferred embodiment of the invention, bracket 62 comprises a curvilinear reinforcing rib 80 beneath kit support surface 74 and attachment surface 76. Rib 80 lends strength and rigidity to bracket 62 without significantly increasing the overall height of its profile. Cylindrical receptacle 82 can be unitarily formed as part of reinforcing rib 80 if desired. Brackets 62 can be made of metal, fiberglass, high impact plastic or any other similarly effective material having sufficient durability to withstand the intended use.

In any case, it is intended that the scope of the invention be limited only by the broadest interpretation of the appended claims to which the inventors are legally entitled.

We claim:

1. A kit comprising:

a foldable sign member having first and second foldably connected side members, and a base wherein the base is foldably connected to a bottom edge of each of the upright side members;

a plurality of elements releasably secured to the sign member, said elements including at least a waste disposal bag, protective gloves, a dustpan, a scraper, and an absorbent pad; and wherein at least one of the plurality of elements is releasably secured to the sign member with a releasable polymeric adhesive.

2. The kit of claim 1, wherein the kit has a substantially flat configuration prior to use.

3. The kit of claim 1 wherein the base comprises first and second base members, said first base member being releasably engageable with said second base member to position said first and second upright side members at a fixed angle relative to each other and to said base members.

4. The kit of claim 3 wherein one of said base members has a foldable tab that is releasably engageable with a cooperatively alignable opening in the other said base member.

5. The kit of claim 3 wherein said base members combine to form the base having a triangular.

6. The kit of claim 1 wherein said first and second side members are disposed upright relative to said base during use.

7. The kit of claim 1 wherein at least one of said side members further comprises at least one of warning graphics or lettering.

8. The kit of claim 1 wherein said first and second side members each have a free edge and said first and second side members are releasably attachable to each other proximal to said free edge of each side member.

9. The kit of claim 1 wherein a foldable spring member is disposed between and attached to the first and second side members.

10. The kit of claim 1 wherein the waste disposal bag is a folded plastic bag that is expandable to a size large enough to contain all other elements of the kit following use.

11. The kit of claim 1 wherein the protective gloves are made of a flexible polymeric material.

12. The kit of claim 1 wherein the dustpan and scraper are made of a substantially rigid polymeric material.

13. The kit of claim 1 wherein the absorbent pad comprises an absorbent filler material.

14. The kit of 1 wherein the absorbent pad comprises a super absorbent polymer.

15. The kit of claim 1 wherein the plurality of elements are releasably secured directly to the sign member.

16. The kit of claim 1 where at least one of the elements is releasably secured to another element that is releasably secured directly to the sign member.

17. The kit of claim 1 wherein the sign member is made of a material selected from the group consisting of cardboard, corrugated board, plastic-coated cardboard, plastic sheet, and laminates thereof.

18. The kit of claim 1 in combination with a plurality of low-profile, under-shelf mounting brackets releasably attachable to a merchandise display shelf.

* * * * *

UNITED STATES PATENT AND TRADEMARK OFFICE

CERTIFICATE OF CORRECTION

PATENT NO. : 7,150,118 B1
APPLICATION NO. : 11/364591
DATED : December 19, 2006
INVENTOR(S) : Benton et al.

It is certified that error appears in the above-identified patent and that said Letters Patent is hereby corrected as shown below:

Column 2
Line 30 - line 3 should be line 3-3.
--broken away, taken along line 3-3 f FIG. 2 to better illustrate--

Column 6
Line 19 – the word shape should be inserted at the end of the sentence.
5. --The kit of claim 3 wherein said base members combine to form the base having a triangular shape.--

Signed and Sealed this

Twenty-second Day of May, 2007

JON W. DUDAS
*Director of the United States Patent and Trademark Office*

UNITED STATES PATENT AND TRADEMARK OFFICE

CERTIFICATE OF CORRECTION

PATENT NO. : 7,150,118 B1
APPLICATION NO. : 11/364591
DATED : December 19, 2006
INVENTOR(S) : Benton et al.

It is certified that error appears in the above-identified patent and that said Letters Patent is hereby corrected as shown below:

Column 2
Line 30 - line 3 should be line 3-3.
--broken away, taken along line 3-3 of FIG. 2 to better illustrate--

Column 6
Line 19 – the word shape should be inserted at the end of the sentence.
5. --The kit of claim 3 wherein said base members combine to form the base having a triangular shape.--

This certificate supersedes Certificate of Correction issued May 22, 2007.

Signed and Sealed this

Thirtieth Day of October, 2007

JON W. DUDAS
*Director of the United States Patent and Trademark Office*